US005509732A

United States Patent [19]

Adamski et al.

[11] Patent Number: 5,509,732

[45] Date of Patent: Apr. 23, 1996

[54] MIXER ASSEMBLY

[75] Inventors: Robert P. Adamski, Missouri City; Eugene L. Holloway, Richmond; Robert B. Wood, Bellville, all of Tex.

[73] Assignee: Shell Oil Company, Houston, Tex.

[21] Appl. No.: 357,828

[22] Filed: Dec. 16, 1994

[51] Int. Cl.[6] ..... B01F 13/00

[52] U.S. Cl. ..... 366/349; 366/292; 366/300

[58] Field of Search ..... 366/349, 292, 366/297–301, 325, 330

[56] References Cited

U.S. PATENT DOCUMENTS

| | | | |
|---|---|---|---|
| 2,990,978 | 7/1961 | Charos | 366/297 X |
| 5,046,856 | 9/1991 | McIntire | 366/291 |

OTHER PUBLICATIONS

Brochure–Model EDPT–114–Electrostatic Dehydration and Precipitation Tester.

*Primary Examiner*—David Scherbel

*Assistant Examiner*—Patrick F. Brinson

[57] ABSTRACT

The invention relates a mixer assembly for mixing liquids in a tubular container including: (a.) an electrically conductive central shaft member, (1) having a top end portion and a bottom end portion; (2) where the central shaft member is oriented longitudinally along the length of the mixing blade assembly; and (3) wherein the central shaft member is threaded along at least a portion of its circumference; (b.) a plurality of shearing members fixedly attached to the central shaft member for shearing the liquids when the shaft member is rotated; (c.) a vortex breaker member positioned below the blade members and above the bottom end portion of the central shaft member; wherein the vortex breaker member comprises: (1) a concave-shaped disk having an aperture substantially at its center, (2) wherein the central shaft member is positioned through, and fixedly attached at, the aperture of the vortex breaker member; (3) wherein the concave-shaped side of the vortex breaker member is oriented toward the bottom end portion of the central shaft member; (4) wherein all points along the perimeter of the circumference of the vortex breaker member are substantially equidistance from the center of the central shaft member.

20 Claims, 2 Drawing Sheets

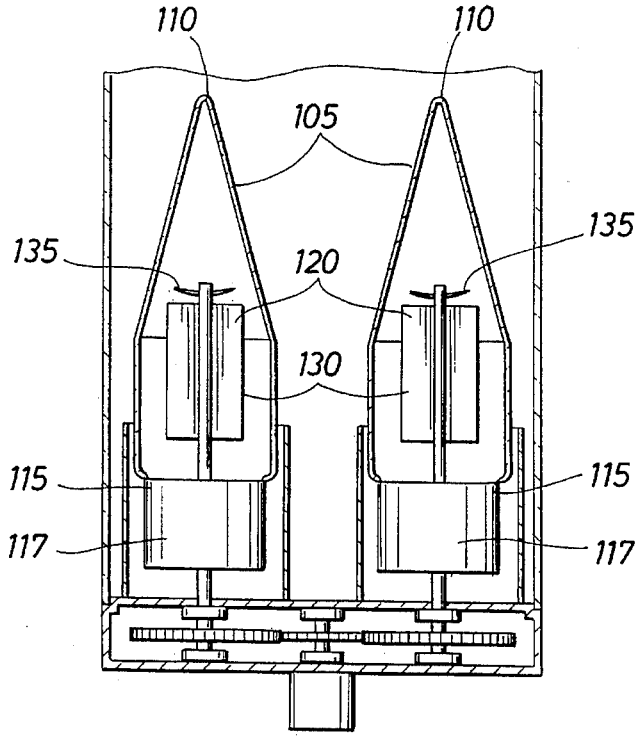
FIG. 1
FIG. 2
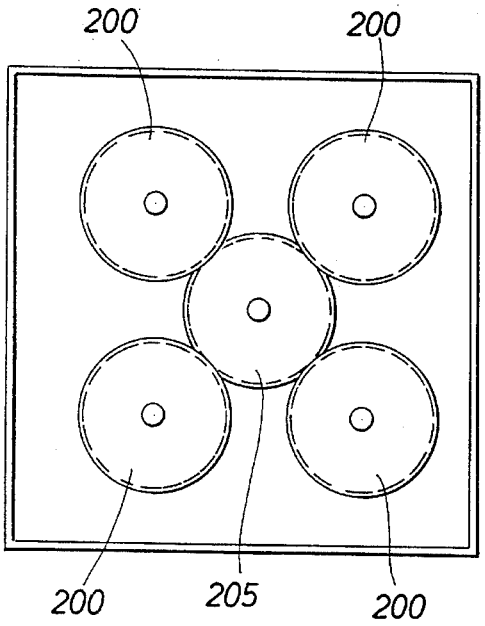
FIG. 3
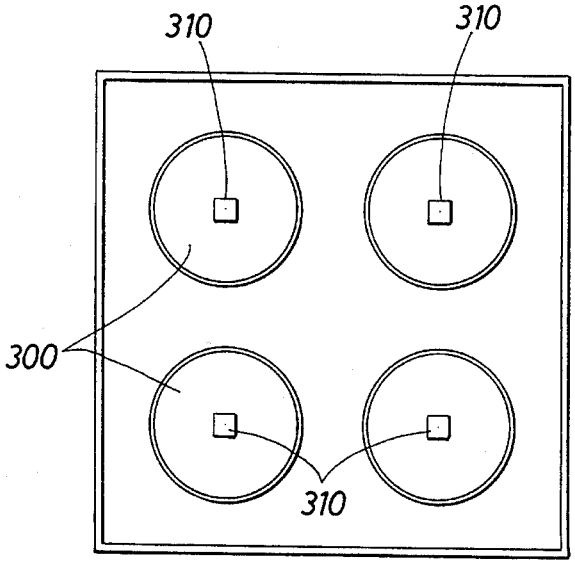

MIXER ASSEMBLY

I. FIELD OF THE INVENTION

The invention relates to a mixer assembly for mixing two or more sets of liquid components under the same conditions for later testing of the resulting sets of mixtures.

II. BACKGROUND OF THE INVENTION

A. Introduction

The mixer assembly of the invention is particularly suitable for use in mixing samples for testing in an electrostatic coalescer test unit. Full scale electrostatic coalescers are used for crude oil dehydration in both Production and Refining. These devices enhance the coalescence of water droplets by the use of an applied electric field. In a strong electric field, water droplets have an induced dipole and are deformed into an ellipsoidal shape. Attraction between the positive and negative ends of adjacent water droplets is a driving force for coalescence. Distortion of the stabilizing emulsifier film (solids, surfactants, asphaltenes, and other compounds) surrounding the water droplets also assists in droplet coalescence.

Chemical additives, such as demulsifiers and solids-wetting agents, are often used in conjunction with applied electric fields for crude oil dehydration. These additives function to destabilize the emulsifier film surrounding the water droplets. Portable batch electrostatic coalescers are used by chemical vendors to conduct quick screening tests for selecting the best chemical additive package for a given crude oil/brine system. These experiments rank order the relative performance of different additive packages and approximate their performance in commercial-scale electrostatic coalescers.

B. Known Devices

InterAv markets a commercially available electrostatic coalescer. Petrolite & Betz have built portable electrostatic coalescers in-house. The InterAv device uses an electrode configuration which is susceptible to electrical shorting when the water concentration gets too high, since both electrodes are immersed in the sample. In the InterAv electrostatic coalescer, there is no means for mixing the sample directly in the tube which is used in the electrostatic coalescer. Demulsifier additives for use in electrostatic coalescers are conventional and many varieties of demulsifiers are commercially available from vendors such as Petrolite and Betz.

III. SUMMARY OF THE INVENTION

The invention relates a mixer assembly for mixing liquids in a tubular container including:

a. an electrically conductive central shaft member,
   (1) having a top end portion and a bottom end portion;
   (2) where the central shaft member is oriented longitudinally along the length of the mixing blade assembly; and
   (3) wherein the central shaft member is threaded along at least a portion of its circumference;

b. a plurality of shearing members fixedly attached to the central shaft member for shearing the liquids when the shaft member is rotated;

c. a vortex breaker member positioned below the blade members and above the bottom end portion of the central shaft member; wherein the vortex breaker member comprises:

(1) a concave-shaped disk having an aperture substantially at its center,
   (2) wherein the central shaft member is positioned through, and fixedly attached at, the aperture of the vortex breaker member;
   (3) wherein the concave-shaped side of the vortex breaker member is oriented toward the bottom end portion of the central shaft member;
   (4) wherein all points along the perimeter of the circumference of the vortex breaker member are substantially equidistance from the center of the central shaft member.

IV. BRIEF DESCRIPTION OF THE DRAWINGS

FIG. 1 is a side view of one embodiment of the mixer assembly.

FIGS. 2 and 3 depict a top view of gear arrangement and coupler element respectively, in the mixer assembly in two embodiments.

C. Problems Solved

Figure 4:
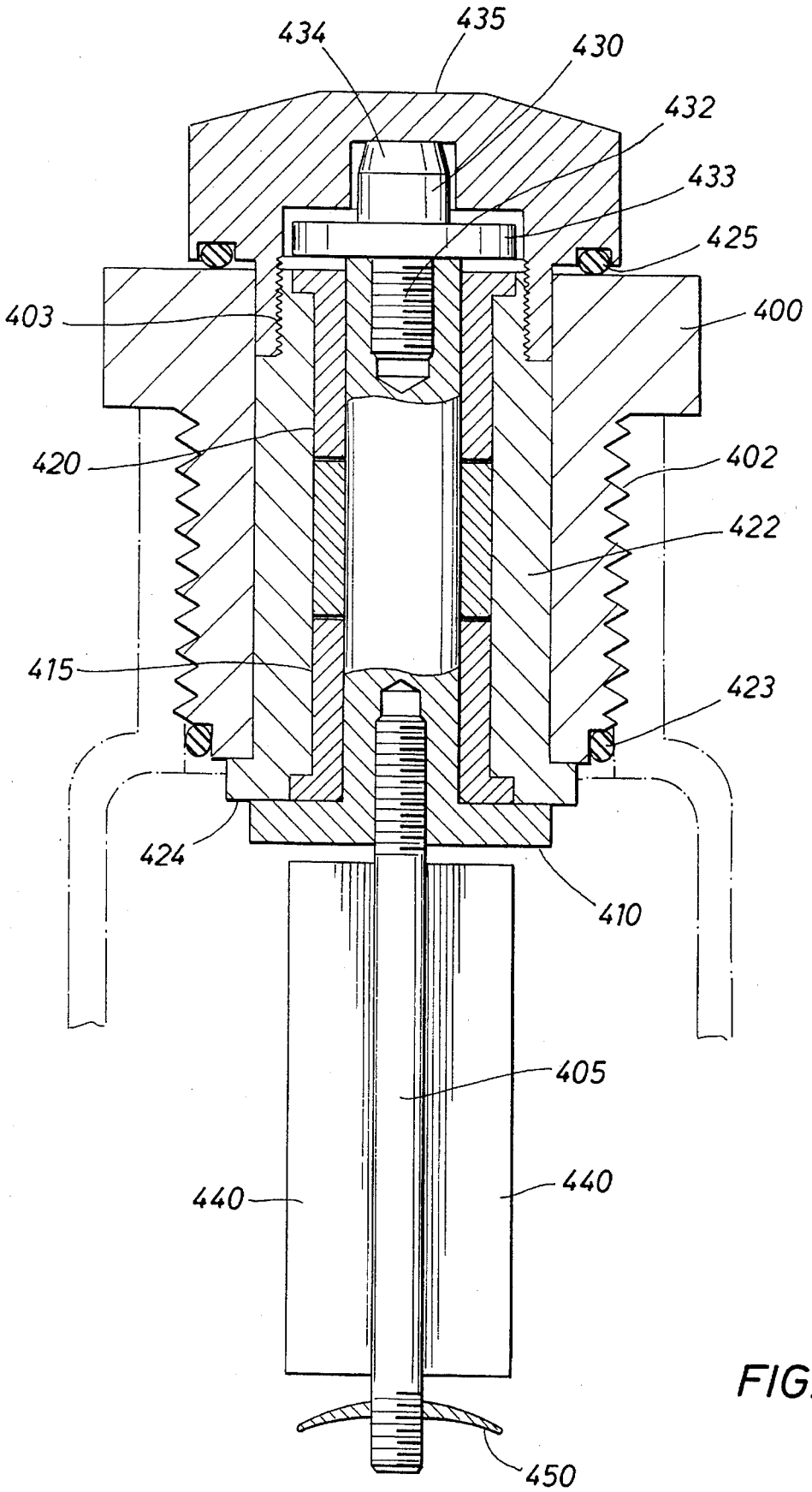
FIG. 4 is side cut away view of one embodiment of the stopper member and corresponding assembly.

Use of independent but simultaneous mixing of the 4 sample tubes to allow for mixing under the same conditions and to allow for greater flexibility and efficiency when planning an experiment.

D. Uses

The mixer assembly of this invention is useful in any application where it is desirable to mix multiple samples under the same conditions. The invention is particularly suited for use in combination with an electrostatic coalescer testing apparatus. Such a combined usage has several valuable uses in the oil/chemical industry. First, such a combined usage with the mixer assembly invention allows optimization of performance of refinery desalters. Specifically, such combined usage permits optimization of the demulsifier treatments in such desalters. In this regard, the combined usage of the mixer assembly with an electrostatic coalescer can be utilized in both a preventative and curative fashion. That is, the oil feed and water and potential demulsifier additives can be mixed and tested in advance of running them in the electrostatic coalescer to determine the best amount and type of demulsifier to be used. In the curative sense, if an emulsion layer in an electrostatic coalescer grows too large and/or unduly increases, samples of that layer can be mixed and tested in the testing apparatus to determine a type and/or amount of a demulsifier effective to reduce the size of the emulsion layer. Variations in electrical potential can also be tested in this way.

Second, such a combined usage is also optionally useful to determine the effect of slop oil addition to desalters for determining, e.g., maximum slop oil that may be added or additional demulsifier quantities or types needed when slop oil is added.

Third, the combined usage of the mixer assembly of this invention an a portable batch electrostatic coalescer can be valuable in new applications where mixing of multiple samples under the same conditions and/or electrostatic coalescers have not traditionally been used. For example, it could be used to determine the feasibility of using strong electric fields for coalescing water droplets in water-washed polymer cements.

V. DETAILED DESCRIPTION OF THE INVENTION

A. Overview

The oil/water mixing apparatus, i.e., mixer assembly, prepares emulsion samples in specially made thick walled centrifuge tubes. The tubes are typically glass since this permits visible inspection and prevents any significant electrical conduction. Glass tubes are of sufficient thickness to not break under normal usage with this apparatus. Two millimeters or more of thickness is typically sufficient. The volume of the tubes can vary but the size and shape must match up with the tubular recesses in the heating block/electrode. About 75 ml or more is typical. The centrifuge tubes accept a Nylon plug fitted with a built in mixer-bushing assembly. A separate direct gear drive mechanism converts a single mixer spindle to one that accommodates four tubes simultaneously. The direct gear drive mechanism is optionally constructed to mount on, for example, a standard commercial blender base, e.g., a Waring brand blender. Centrifuge tubes are inverted into a positioning sleeve and then locked into place on the drive pin. Mixing speed is, optionally, controlled using a variable transformer connected to the blender motor. The duration of mixing is optionally controlled by any conventional electronic device suitable for precision timing of the on/off switching of an electrical appliance. A variety of mixer blade designs and shaft lengths can be attached to the mixer-bushing assembly inside the centrifuge tubes. Typically a 4-fin, 7.5 cm long stainless steel paddle mixer may be used.

Once emulsions of suitable drop size distribution are prepared, the samples are exposed to a strong electric field in the batch electrostatic coalescer. Various geometries can be used to accommodate various pluralities of tubes. In one embodiment, up to four centrifuge tubes can be run at a time. The coalescer testing apparatus uses an AC field. The field is typically at 60 Hz. Alternatively, the coalescer testing apparatus can utilize a DC (i.e., rectified AC) field. Maximum AC operating potential can vary from 0 to about 8,000 volts (RMS). Electric fields across the samples can be independently set since each has its own transformer and variable voltage controller. Separate voltage read-outs are also present. Optionally, an electronic digital timer with automatic power shut-down is used to start and stop an experiment.

B. Electrical Fields

Electric fields in a batch electrostatic coalescer are generated using the mixing blade inside each centrifuge tube (of the mixer assembly of the invention) as the energized electrode. The centrifuge tubes of the mixer assembly of the invention are placed inside the slots of an aluminum heat block which functions as the ground electrode. Use of one internal electrode and one external electrode in this way eliminates the possibility of electrical arcing. The aluminum heat block also permits the emulsion samples to be preheated up to temperature which will best emulate the conditions inside an industrial size coalescer. Typically, the heating block is heated to about 250° F. before applying the electrical field. Typically, the maximum controllable temperature of the heating block is about 300° F.

VI. DETAILED DESCRIPTION OF THE DRAWINGS

FIG. 1 is a side view of one embodiment of the mixer assembly. Glass tubular containers 105 are in an inverted position, i.e., with closed ends 110 higher than open ends 115. Stopper member 117 is removably/threadably attached to the open end 115 of tubular container 105. The closed end of tubular containers 105 are typically funnel-shaped. Mixing blade/electrodes 120 are made of central shaft member 125 and shearing member 130. Shearing member 130 optionally is a paddle member or impellers, each of which typically is positioned substantially equidistance along the circumference of the central shaft member 125. Where the shearing member 130 is a paddle member, it is optionally rectangular and optionally one of the longitudinal edges is fixedly attached to central shaft member 125. The paddle members optionally have perforations or apertures therein for increasing the shearing effect of the paddle members. Vortex breaker member 135 is fixedly attached on central shaft member 125 "below" (when closed end of container is down) shearing member 130.

FIGS. 2 and 3 depict a top view of gear arrangement and coupler element respectively, in the mixer assembly in two embodiments. FIG. 2 shows one geometric embodiment of the slave gears 200 and master gear 205. Master gear 205 drives slave gears 200. Thus, each slave gear is rotated at the same rate. FIG. 3 shows slave gears 300 where each slave gear has a driving pin coupler member 310 fixedly attached thereto. As discussed below in the description of FIG. 4, the driving pin coupler member 310 engages a corresponding coupler member 430 on the stopper member assembly for driving the rotation of the central shaft member and attached shearing members.

FIG. 4 is side cut away view of one embodiment of the stopper member and corresponding assembly. Stopper member 400 has threads around its outer circumference and is threadably attached to tubular container 402. Tubular container 402 has a threaded portion at its open end and the threaded portion is on the inside of the container wall.

The remaining parts are all connected directly or indirectly to the stopper member 400. Thus, when all the parts are assembled the stopper member is attached and detached as a unit from the tubular container 402. Stopper member 400 has a tubular hollow portion along its interior center axis which runs the entire length of the stopper member.

Sleeve casing member 422 is tubular and is pressure fitted inside the hollow of stopper member 400 from the bottom of the stopper member. Sleeve casing member 422 has an integral flange 424 at its bottom portion. Flange 424 abuts the bottom portion of stopper member 400, thus preventing further upward movement of sleeve casing member 422 within the hollow of stopper member 400.

Upper bushing member 420 and lower bushing member 415 are pressure fitted inside the interior of sleeve casing member 422. Both bushing members have integral flanges on one end for abutting an end portion of the sleeve casing member and limiting the distance the bushing member can be pressure fitted into the sleeve casing member.

Spindle member 410 is removably positioned along the interior of bushing member 415 and 420. Spindle member 410 is not pressure fitted. It is manufactured so as to have low tolerances between its outer diameter and the interior diameter of the bushing members. Thus manufactured the spindle member 410 can rotate within the bushing members without substantial play or vibration. Bushing members 415 and 420 are typically oil impregnated metals which provides lubrication between the bushing members and the spindle member when the spindle member is rotated.

The spindle member 410 has a threaded recess (or hollow) at its top portion and a threaded recess, or optionally non-threaded recess, at its bottom portion. The threaded recess at the top portion of the spindle member 410, is for threaded attachment to a coupling member 430. Coupling member 430 has threaded portion 432 for threaded attachment to the top portion of the spindle member 410. An integral flange portion 433 rotatably abuts the top portion of upper bushing member 420 and/or the upper portion of sleeve casing member 422. Thus, the flange portion 433 prevents spindle member from falling out the bottom of the assembly.

The top portion of coupler 430 is adapted for mating with a corresponding coupling member attached to a gear for rotating the coupler 430, spindle 410, and central shaft 405. Central shaft 405 is either fixedly or removably attached within the lower recess portion of the spindle member 410. Shearing members 440 are fixedly attached to the lower portion of central shaft 405. Below shearing members 440, vortex breaker member 450 is fixedly attached to central shaft 405.

Sleeve casing member 422 has a threaded upper portion 403 along its exterior circumference. Those threads are for threadable attachment to pressure cap member 435. Pressure cap member 435 fits over coupler member 430 for preventing any fluid leakage or pressure loss out of the tubular container after it is heated and pressure develops. Pressure cap 435 is in electrical connection with coupler 430. In the electrical coalescer testing apparatus, one electrode will be attached to the pressure cap for electrical connection through the pressure cap 435 to coupler member 430 to spindle member 410 to central shaft member 405 and shearing members 440.

O-ring 425 is positioned between a bottom portion of the pressure cap 435 and a top portion of stopper member 400. Thus, O-ring 425 makes a gas and liquid seal between pressure cap 435 and stopper member 400. O-ring 423 is positioned between a top portion of flange 424 of sleeve casing member 422, a bottom portion of stopper member 400, and bottom portion, and at the base of threads on, tubular container 402. Thus, O-ring 423 forms a gas and liquid seal between these elements.

What is claimed is:

1. A mixer assembly for mixing liquids in a tubular container comprising:

a. an electrically conductive central shaft member,
(1) having a top end portion and a bottom end portion;
(2) wherein said central shaft member is oriented longitudinally along the length of said mixing blade assembly; and
(3) wherein said central shaft member is threaded along at least a portion of its circumference;

b. a plurality of shearing members fixedly attached to said central shaft member for shearing said liquids when said shaft member is rotated;

c. a vortex breaker member positioned below said blade members and above said bottom end portion of said central shaft member; wherein said vortex breaker member comprises:
(1) a concave-shaped disk having an aperture substantially at its center,
(2) wherein said central shaft member is positioned through, and fixedly attached at, said aperture of said vortex breaker member;
(3) wherein the concave-shaped side of said vortex breaker member is oriented toward the bottom end portion of said central shaft member;
(4) wherein all points along the perimeter of the circumference of said vortex breaker member are substantially equidistance from the center of said central shaft member;

d. a stopper member for removably affixing said mixing assembly inside a tubular container, said stopper member;
(1) having threads around at least a portion of its circumference, for removably affixing said stopper member to said tubular container;
(2) having a passage substantially through its center; and
(3) wherein said stopper member is in threaded communication with threads of an open end of said tubular containers;

e. a sleeve casing member oriented within and along substantially the same axis of said passage of said stopper member for receipt of a pair of bushing members;

f. a pair of bushing members for receipt of a spindle member;
(1) one of said bushing members disposed within and along substantially the same axis as a lower portion of said sleeve casing member;
(2) another of said bushing members disposed within and along substantially the same axis as an upper portion of said sleeve casing member;

g. a spindle member positioned within and along substantially the same axis as said pair of bushing members,
(1) said spindle member having threaded hollows at its top and bottom end portions for attachment of a coupling to its top end portion and said central shaft member to its bottom portion;

h. a coupling member,
(1) having a threaded lower portion,
(2) wherein said coupling member is in threaded communication with the threaded hollow of the top end portion of said spindle member, and
(3) a top portion of said coupling member is for removable mated connection to a corresponding coupling member attached to a gear for rotating said mixing blade assembly;

i. wherein said sleeve casing member is threaded around the circumference of an upper portion thereof; and j. a pressure cap member for preventing leakage of gas or liquid when said liquids are heated;
(1) said pressure cap member having a threaded hollow in a bottom portion thereof for removable attachment to the threads around the circumference of the upper portion of said sleeve casing member;
(2) wherein when said central shaft member is being rotated for mixing said liquids, said pressure cap is not attached to said sleeve casing member; and
(3) wherein when said liquids are being heated and said central shaft member is not being rotated, said pressure cap member is threadably attached to said sleeve casing member.

2. A mixer assembly for mixing liquids in a tubular container comprising:

a. an electrically conductive central shaft member,
(1) having a top end portion and a bottom end portion;
(2) wherein said central shaft member is oriented longitudinally along the length of said mixing blade assembly; and
(3) wherein said central shaft member is threaded along at least a portion of its circumference;

b. a plurality of shearing members fixedly attached to said central shaft member for shearing said liquids when said shaft member is rotated;

c. a vortex breaker member positioned below said blade members and above said bottom end portion of said central shaft member; wherein said vortex breaker member comprises:

(1) a concave-shaped disk having an aperture substantially at its center, (2) wherein said central shaft member is positioned through, and fixedly attached at, said aperture of said vortex breaker member;

(3) wherein the concave-shaped side of said vortex breaker member is oriented toward the bottom end portion of said central shaft member;

(4) wherein all points along the perimeter of the circumference of said vortex breaker member are substantially equidistance from the center of said central shaft member.

3. The mixer assembly according to claim 2, wherein said plurality of shearing members comprise paddle members positioned substantially equidistance along the circumference of said central shaft member.

4. The mixer assembly according to claim 3, wherein said plurality of paddle members comprise from 2 to 6 paddles.

5. The mixer assembly according to claim 4, wherein said plurality of paddle members comprise 4 paddles.

6. The mixer assembly according to claim 4, wherein said paddle members are rectangular and wherein one of the longitudinal edges is fixedly attached to said central shaft member.

7. The mixer assembly according to claim 4, wherein said paddle members have perforations or apertures therein for increasing the shearing effect of the paddle members.

8. The mixer assembly according to claim 3, wherein said paddle members are electrically conductive and are in electrical connection with said central shaft member.

9. The mixer assembly according to claim 1, wherein said plurality of shearing members comprise impellers positioned substantially equidistance along the length of said central shaft member.

10. The mixer assembly according to claim 2, wherein said tubular container has a closed end and an open end, wherein the closed end of said tubular container is funnel-shaped and wherein at least a portion of the open end of said tubular container is threaded on its internal surface.

11. The mixer assembly according to claim 2, further comprising a stopper member for removably affixing said mixing assembly inside a tubular container, said stopper member;

a. having threads around at least a portion of its circumference, for removably affixing said stopper member to said tubular container;

b. having a passage substantially through its center; and c. wherein said stopper member is in threaded communication with threads of an open end of said tubular container.

12. The mixer assembly according to claim 11, further comprising:

a. a sleeve casing member oriented within and along substantially the same axis of said passage of said stopper member for receipt of a pair of bushing members;

b. a pair of bushing members for receipt of a spindle member;

(1) one of said bushing members disposed within and along substantially the same axis as a lower portion of said sleeve casing member;

(2) another of said bushing members disposed within and along substantially the same axis as an upper portion of said sleeve casing member;

c. a spindle member positioned within and along substantially the same axis as said pair of bushing members, (1) said spindle member having threaded hollows at its top and bottom end portions for attachment of a coupling to its top end portion and said central shaft member to its bottom portion.

13. The mixer assembly according to claim 12, further comprising a coupling member, a. having a threaded lower portion, b. wherein said coupling member is in threaded communication with the threaded hollow of the top end portion of said spindle member, and c. a top portion of said coupling member is for removable mated connection to a corresponding coupling member attached to a gear for rotating said mixing blade assembly.

14. The mixer assembly according to claim 12, wherein said sleeve casing member is threaded around the circumference of an upper portion thereof; and d. further comprising a pressure cap member for preventing leakage of gas or liquid when said liquids are heated;

(1) said pressure cap member having a threaded hollow in a bottom portion thereof for removable attachment to the threads around the circumference of the upper portion of said sleeve casing member;

(2) wherein when said central shaft member is being rotated for mixing said liquids, said pressure cap is not attached to said sleeve casing member; and (3) wherein when said liquids are being heated and said central shaft member is not being rotated, said pressure cap member is threadably attached to said sleeve casing member.

15. The mixer assembly according to claim 14, further comprising an O-ring member positioned between said pressure cap member and said stopper member for forming a seal to liquid and gas.

16. The mixer assembly according to claim 12, further comprising an electrical connection member fixedly attached to said top end portion of said central shaft member.

17. The mixer assembly according to claim 16, wherein said top end portion of said central shaft member protrudes through substantially the center of said threaded stopper member, and wherein said electrical connection member comprises said top end portion of said central shaft member.

18. A mixer assembly for mixing liquids in a tubular container comprising:

a. an electrically conductive central shaft member, (1) having a top end portion and a bottom end portion;

(2) wherein said central shaft member is oriented longitudinally along the length of said mixing blade assembly; and (3) wherein said central shaft member is threaded along at least a portion of its circumference;

b. a plurality of shearing members fixedly attached to said central shaft member for shearing said liquids when said shaft member is rotated;

c. a vortex breaker member positioned below said blade members and above said bottom end portion of said central shaft member; wherein said vortex breaker member comprises:

(1) a concave-shaped disk having an aperture substantially at its center, (2) wherein said central shaft member is positioned through, and fixedly attached at, said aperture of said vortex breaker member;

(3) wherein the concave-shaped side of said vortex breaker member is oriented toward the bottom end portion of said central shaft member;

(4) wherein all points along the perimeter of the circumference of said vortex breaker member are substantially equidistance from the center of said central shaft member;

d. a stopper member for removably affixing said mixing assembly inside a tubular container, said stopper member;

(1) having threads around at least a portion of its circumference, for removably affixing said stopper member to said tubular container;

(2) having a passage substantially through its center; and (3) wherein said stopper member is in threaded communication with threads of an open end of said tubular container;

e. a sleeve casing member oriented within and along substantially the same axis of said passage of said stopper member for receipt of a pair of bushing members;

f. a pair of bushing members for receipt of a spindle member;

(1) one of said bushing members disposed within and along substantially the same axis as a lower portion of said sleeve casing member;

(2) another of said bushing members disposed within and along substantially the same axis as an upper portion of said sleeve casing member;

g. a spindle member positioned within and along substantially the same axis as said pair of bushing members, (1) said spindle member having threaded hollows at its top and bottom end portions for attachment of a coupling to its top end portion and said central shaft member to its bottom portion; and h. a coupling member, (1) having a threaded lower portion, (2) wherein said coupling member is in threaded communication with the threaded hollow of the top end portion of said spindle member, and (3) a top portion of said coupling member is for removable mated connection to a corresponding coupling member attached to a gear for rotating said mixing blade assembly.

19. The mixer assembly according to claim 17, wherein said sleeve casing member is threaded around the circumference of an upper portion thereof; and a. further comprising a pressure cap member for preventing leakage of gas or liquid when said liquids are heated;

(1) said pressure cap member having a threaded hollow in a bottom portion thereof for removable attachment to the threads around the circumference of the upper portion of said sleeve casing member;

(2) wherein when said central shaft member is being rotated for mixing said liquids, said pressure cap is not attached to said sleeve casing member; and (3) wherein when said liquids are being heated and said central shaft member is not being rotated, said pressure cap member is threadably attached to said sleeve casing member.

20. The mixer assembly according to claim 18, further comprising:

a. an O-ring member positioned between said pressure cap member and said stopper member for forming a seal to liquid and gas; and b. an electrical connection member removably attached to said top end portion of said central shaft member.

* * * * *